US005972875A

United States Patent [19]

Crutcher et al.

[11] Patent Number: 5,972,875

[45] Date of Patent: Oct. 26, 1999

[54] LOW-FOAMING AMINE OXIDE SURFACTANT CONCENTRATE AND METHOD OF MANUFACTURE

[76] Inventors: Terry Crutcher, 3018 Yarmouth Greenway, Ste. 102, Fitchburg, Wis. 53711; Timothy E. Janota, 606 W. Rollin, Edgerton, Wis. 53534

[21] Appl. No.: 09/173,347

[22] Filed: Oct. 15, 1998

Related U.S. Application Data

[63] Continuation-in-part of application No. 08/842,242, Apr. 23, 1997.

[51] Int. Cl.[6] ..... C11D 1/75

[52] U.S. Cl. ..... 510/421; 510/433; 510/503

[58] Field of Search ..... 510/421, 433, 510/503

[56] References Cited

U.S. PATENT DOCUMENTS

| | | | |
|---|---|---|---|
| 3,356,727 | 12/1967 | Koebner et al. | 260/570.7 |
| 3,449,431 | 6/1969 | Swenson et al. | 260/584 |
| 3,457,312 | 7/1969 | Miller, Jr. et al. | 260/584 |
| 3,494,962 | 2/1970 | Miller, Jr. et al. | 260/570.8 |
| 4,416,808 | 11/1983 | Blaschke et al. | 252/547 |
| 4,548,744 | 10/1985 | Connor | 252/545 |
| 4,561,998 | 12/1985 | Wertz et al. | 252/547 |
| 5,164,121 | 11/1992 | Smith et al. | 252/547 |

FOREIGN PATENT DOCUMENTS 42188 12/1981 European Pat. Off. .

OTHER PUBLICATIONS

"Cationic Surfactants: Organic Chemistry", J. M. Richmond, ed., Marcel Dekker, Inc., New York, pp. 275–295, 1990 no month available.

"Kirk–Othmer Encyclopedia of Chemical Technology", 3rd ed., M. Grayson, ed., vol. 2, pp. 259–271, 1985 no month available.

*Primary Examiner*—J. R. Hardee

*Attorney, Agent, or Firm*—Jansson, Shupe, Bridge & Munger, Ltd.

[57] ABSTRACT

A pourable low-foaming alkoxylated amine oxide surfactant concentrate and method for making the concentrate are disclosed. The amine oxide concentrate has novel properties in that it is both highly concentrated and pourable at ambient temperatures. The amine oxides of the amine oxide concentrate include from about 3.5–30 moles of alkoxylated units and may be based on ether and/or fatty tertiary amine precursors. The low foaming properties and pourability of the amine oxide surfactant concentrate make the invention ideal for low-foam applications and for use in surfactant formulations.

22 Claims, No Drawings

LOW-FOAMING AMINE OXIDE SURFACTANT CONCENTRATE AND METHOD OF MANUFACTURE

RELATED APPLICATION

This application is a continuation-in-part of U.S. patent application Ser. No. 08/842,242 filed Apr. 23, 1997.

FIELD OF THE INVENTION

This invention is related generally to surfactants and, more particularly, to highly concentrated pourable low-foaming alkoxylated amine oxide surfactants.

BACKGROUND OF THE INVENTION

Surfactant systems which produce little or no foam and which are easy to handle and prepare are required for many different commercial and household applications. These applications include, without limitation, waste water treatment, manufacture of textiles, paper processing, machine dish washing, high pressure cleaning, carpet cleaning, laundering and hard surface cleaning. As can be appreciated, generation of unnecessary foam in such applications could interfere with any of these respective processes.

Each of these exemplary applications include conditions conducive to formation of undesirable foam. Foam generation would be expected because of the agitation and shear forces applied.

Surfactants which can be categorized as "low foaming" or "ultra-low foaming" are best suited for applications such as those described above. By low or ultra-low foaming, it is meant that very little or no foam is generated by the surfactant when agitated. Further, any foam which is generated is typically unstable and rapidly breaks down preventing accumulation of foam during the process. These types of low-foaming systems are to be contrasted with so-called "high foaming" systems in which copious amounts of foam are generated and the foam remains stable for a long period of time.

Amine oxides are known surface-active agents and would be useful in applications such as those listed above, but for the fact that they are known to be high-foaming or difficult to prepare and handle at appropriate concentrations. With respect to foaming, it is known that amine oxides are added to various compositions as foaming agents, foam enhancers or foam stabilizers. Because of these foam-generating characteristics, amine oxides are typically found in shampoos, bath preparations and hand dish detergents. Two broad classes of amine oxides typically used in these applications include dimethyl alkyl amine oxides and bis(2-hydroxyethyl) alkyl amine oxides. These amine oxides are thought of as medium to high foaming surfactants which contribute to the overall foamability and foam stability of the detergents and cleaning compositions.

Alkoxylated amine oxides are another group of amine oxides understood to be high foaming. For example, U.S. Pat. No. 3,449,431 (Swenson) repeatedly characterizes certain alkoxylated amine oxides as suds builders and not as low foaming surfactants. Such molecules would be unsatisfactory for the low-foaming applications described above.

It is known that additives, such as oil and silicone, can be added to surfactant systems or processes to reduce or eliminate foaming. However, these additives are less than satisfactory because they increase the cost of the surfactant system and can leave unwanted films or deposits on the surface to be cleaned. One object of this invention is to eliminate the need for such additives.

It should be noted that U.S. Pat. No. 5,486,315 (Tseng) claims that certain forms of dimethyl alkyl amine oxide surfactants actually produce low levels of foam. However, Tseng involves a narrow class of molecules in which the side chains (designated $R_1$) are limited to a total of two moles of alkyl and/or hydroxyalkyl groups. These narrowly-defined structures are outside the scope of the present invention.

Another significant disadvantage with prior art amine oxides is that the compositions cannot be prepared in a highly concentrated "high actives" form which is pourable. The term "actives" refers to the amine oxide which is the active constituent of the concentrate. The prior art amine oxides exist as thick viscous gels above about 40% actives at ambient temperature, i.e., about 20° C. In most industrial settings, raw materials which are liquid and pourable at room temperature are preferred over raw materials which are viscous and nonpourable at such temperatures. Obviously, pourable liquids are preferred because of the ease of handling associated with liquids. Special handling techniques are needed to handle solids and highly viscous liquids typical of prior art concentrated forms of amine oxides.

These disadvantages are apparent in commercially-available amine oxides. These products are available in a pourable form but typically include no more than 40 weight percent of amine oxide and 60 or more weight percent of water. The low level of amine oxides and high water content is required to prevent formation of gelatinous or viscous products. This is disadvantageous, however, because of the added shipping cost associated with shipping inert water with the amine oxide. Further, the opportunity to use the amine oxide in a concentrated formulation is limited.

Organic solvents, such as isopropanol or ethanol, have also been used to liquify amine oxides of the prior art. The ratio of amine oxide to solvent (as compared to the ratio of amine oxide to water noted above) is improved in that solutions of up to about 70% amine oxide and about 30% solvent can be made this way. However, use of solvents increases the cost of the product and can create safety concerns due to the flammability of the solvent. Use of such solvents may also raise environmental concerns due to the presence of volatile organic compounds (VOC). Further, a 70% actives level composition is not as desirable as a concentrate including in excess of 90% actives.

An ideal surfactant for the applications described above should have low foaming properties. The surfactant should be capable of being highly concentrated, and preferably should be a pourable liquid at room temperature. The surfactant should also have good surface-active characteristics, be compatible with other detergent ingredients and should be biodegradable. An improved surfactant with all of these characteristics would represent an important advance in the art.

OBJECTS OF THE INVENTION

It is an object of this invention to provide an improved amine oxide surfactant concentrate and method for making the concentrate and overcoming some of the problems and shortcomings of compositions of the prior art.

Another object of this invention is to provide an improved amine oxide surfactant concentrate with low foaming properties and which is useful in [low] surfactant applications where foaming is not desired.

An additional objective of this invention is to provide an improved amine oxide surfactant concentrate which can be prepared in a highly concentrated, "high actives" form with from about 50–99% amine oxide.

Still another object of the invention is to provide an improved amine oxide surfactant and surfactant concentrate which is a pourable liquid at room temperature.

Yet another object of this invention is to provide an improved amine oxide surfactant concentrate which has good surface-active characteristics.

It is a further object of this invention to provide an improved amine oxide surfactant and surfactant concentrate which is easy to handle.

Another object of this invention is to provide an improved amine oxide surfactant concentrate which is biodegradable and is compatible with other detergent ingredients.

An additional object of this invention is to provide a method of making the improved amine oxide surfactant concentrate which results in a high actives, pourable liquid.

These and other important objects will be apparent from the following descriptions of this invention which follow.

DETAILED DESCRIPTION OF THE INVENTION

This invention is directed to novel amine oxide surfactant concentrates which have high actives, are pourable and produce low levels of foam. The invention is also directed to the method of making such novel concentrates. The amine oxide surfactant concentrates may be diluted, mixed with other constituents and formulated into low foaming surfactant compositions for use by end users.

The amine oxide surfactant concentrates of the invention have novel and valuable properties not previously believed to exist. Specifically, the surfactant concentrates produce low levels of foam, have extremely high concentrations of amine oxides (from about 50–99%) and yet are initially pourable liquids at room temperatures or become pourable high actives liquids upon mixing with a small amount of water.

By "pourable" we mean that the compositions have viscosities of less than about 5000 cps. measured using a Brookfield LVT Viscometer with a #2 spindle. Typically, this viscosity is determined at ambient temperature or, at about 20° C. Such viscosities are preferred for commercial applications where handling and pumpability are important properties.

The data presented in the examples below demonstrate that the invention has both higher actives levels and greater pourability than prior art compositions such as those described in U.S. Pat. No. 3,449,431 (Swenson). Consequently, the invention overcomes problems associated with handling and processing of amine oxides of the prior art which are solids or viscous gels at high amine oxide concentrations.

The inventive concentrate includes an amine oxide constituent and water. Preferably, the amine oxide constituent includes at least one amine oxide having the general structural formula:

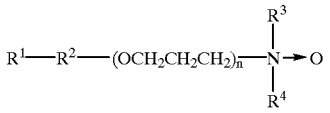

wherein $R^1$ is selected from an alkyl group having between 6 and 22 carbon atoms, and a substituted aryl group having between 7 and 22 carbon atoms; $R^2$ is from 0 to 7 moles of alkoxylated units; n is 0 or 1; and $R^3$ and $R^4$ are each at least one alkoxylated unit and the total number of alkoxylated units present in $R^3$ and $R^4$ is about 3 to 30. Mixtures of amine oxides may be included within the amine oxide constituent. The preferred concentrate also includes less than 50% water.

Preferably, the concentrate includes in excess of 80% amine oxide and less than about 20% water. It is most highly preferred that the concentrate include in excess of 90% amine oxide and less than about 10% water. This final product is typically a clear pourable material at room temperature. There is no evidence of gelatinous phases.

As used throughout the specification and claims, terms such as "between 6 and 22 carbon atoms," "between 7 and 22 carbon atoms" and "$C_6$–$C_{18}$" are used to designate carbon atom chains of varying lengths and to indicate that various conformations are acceptable including branched, cyclic and linear. The terms further designate that various degrees of saturation are acceptable. It should also be understood that the inventive amine oxides may be isolated or present within a mixture and remain within the scope of the invention. Alkoxylated units refer to the individual alkylene oxide units added to the amine. Typically, this means ethyleneoxy, propyleneoxy and butyleneoxy, including isomers.

It is preferred that the alkoxylated units for $R^2$ are selected from ethyleneoxy, propyleneoxy and butyleneoxy and mixtures thereof. It should be noted, however, that variation at the $R^2$ position is intended and that other alkoxylated units, such as styrene oxide, are within the scope of the invention.

Preferred alkoxylated units for $R^3$ and $R^4$ include ethyleneoxy, propyleneoxy, butyleneoxy units including mixtures. It is most highly preferred that $R^3$ and $R^4$ are each comprised of ethyleneoxy units.

Preferred forms of the inventive amine oxides include from about 5 to about 20 moles of alkoxylated units present in $R^3$ and $R^4$. It is most highly preferred that $R^3$ and $R^4$ include from about 5 to 15 moles of alkoxylated units.

In highly preferred forms of the surfactant concentrate, the amine oxide constituent includes amine oxides having an ether linkage in the hydrophobe. These amine oxides have the general structure:

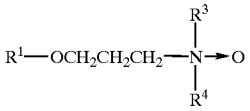

In these embodiments, $R^1$ is selected from a substituted aryl group having between 7 and 22 carbon atoms and an alkyl group having between 6 and 22 carbon atoms; $R^3$ and $R^4$ are each at least one alkoxylated unit and the total number of alkoxylated units present in $R^3$ and $R^4$ is about 3 to 30. It is most highly preferred that $R^3$ and $R^4$ are each alkoxylated units selected from ethyleneoxy, and propyleneoxy (including mixtures) and that from 3.5–10 moles of such alkoxylated units are included.

In yet other preferred embodiments, the amine oxide constituent includes alkyl amine oxides lacking an ether linkage in the hydrophobe. Such surfactant molecules are designated by the general structure:

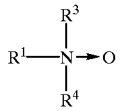

wherein $R^1$ is selected from an alkyl group having between 6 and 22 carbon atoms and a substituted aryl group having between 7 and 22 carbon atoms; $R^3$ and $R^4$ are each at least one alkoxylated unit, and the total number of alkoxylated units present in $R^3$ and $R^4$ is about 3 to 30.

Ethyleneoxy, propyleneoxy and butyleneoxy are highly preferred forms of the alkoxylated units comprising $R^3$ and $R^4$ and it is most highly preferred that $R^3$ and $R^4$ are each an ethyleneoxy unit. Preferably $R^3$ and $R^4$ should comprise a total of from about 5–15 moles of alkoxylated units.

The invention includes a method of making the novel low-foaming amine oxide surfactant concentrate. The amine oxide surfactant concentrate is prepared by introducing a tertiary amine into a 3-neck round bottom flask which serves as the reaction vessel. The tertiary amine has the general structural formula:

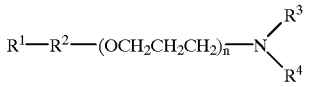

wherein $R^1$ is selected from an alkyl group having between 6 and 22 carbon atoms, and a substituted aryl group having between 7 and 22 carbon atoms; $R^2$ is from 0 to 7 moles of alkoxylated units; n is 0 or 1; and $R^3$ and $R^4$ are each at least one alkoxylated unit and the total number of alkoxylated units present in $R^3$ and $R^4$ is about 3 to 30.

The tertiary amine may be prepared by any of several known methods.

The tertiary amine is then heated to a reaction temperature of about 50–70° C. Lower reaction temperatures may be used but the reaction proceeds at a very slow rate at lower temperatures. If the reaction temperature exceeds about 80° C., decomposition of the amine oxide may occur.

Next, about 100 to 105 molar percent of hydrogen peroxide is added to the amine in the reaction vessel. The hydrogen peroxide is present as a solution including from about 10–75% water. The hydrogen peroxide solution is added to the vessel periodically over a time of about 2–8 hours. The reaction is exothermic and the hydrogen peroxide should be added when the reaction mixture is at or below 70° C.

The tertiary amine and hydrogen peroxide are reacted in the vessel for about 8–48 hours at about 70–80° C. to form the high actives, pourable amine oxide surfactant concentrate. Importantly, and contrary to the teachings of the prior art, it has been found that the high actives amine oxide is pourable without a requirement that solvent or water be added to the reaction mixture as a separate step. However, depending on the tertiary amine used to prepare the product, a minimal amount of water may be added to the concentrate or at any step of the reaction to enhance the pourability of the concentrate.

The finished product is typically a clear liquid which is pourable at room temperature. No gelatinous phases were observed in the finished products. Surpris- ingly, it has been found that the surfactant concentrate consists of from about 50–99% active amine oxide and yet is pourable. These observations are presented in the examples set forth below.

Additional additives may be included in the reaction. For example, chelating agents may be added to stabilize the amine oxide of the concentrate. By way of further example, an acid such as glacial acetic acid, may be added to neutralize the alkaline catalyst commonly used to make the ethoxylated tertiary amine.

The amine oxides of the invention are described as "high actives" because they can be prepared in a highly concentrated, pourable form that consists of about 50–99% by weight of amine oxide and less than 50% by weight of water. The activity level of a surfactant refers to the percentage of surfactant in a given surfactant solution or product. It was previously expected that amine oxides at this activity level would be solids or viscous gels. However, and unlike the prior art, the amine oxide surfactants of Applicants' invention are pourable liquids at room temperature.

The fact that Applicants' amine oxides are effective low foaming surfactants and are highly concentrated pourable liquids has important commercial benefits. One important benefit is that the product is an efficacious surface active agent yet produces only small amounts of foam. Another important benefit is that the product may be sold to formulators in a concentrated form with a very high percentage of amine oxide constituent. Packaging, storage and transportation costs are reduced because of the concentrated form of the product. A further benefit is that organic solvents are not required to liquify the amine oxide. Avoidance of such solvents minimizes environmental and fire safety hazards.

The amine oxide in its concentrated, high actives, form is intended to be incorporated into final formulations by the inclusion of water and potentially other additives, such as alkaline components. For example, it is envisioned that detergent compositions for use as hard surface cleaners could be prepared using the inventive amine oxides together with the following additional constituents:

| Detergent Constituent | Useful Weight % | Preferred Weight % | Highly Preferred Weight % |
|---|---|---|---|
| Amine oxide | 0.01–99 | 1–10 | 1–5 |
| Alkaline component | 0–99 | 1–95 | 10–40 |
| Water | 1–99.99 | 4–98 | 55–89 |

The alkaline component of the detergent compositions typically is selected from the group of compounds commonly known as organic and inorganic detergent builders, which are referenced in *McCutcheon's; Vol. 2: Functional Materials*, North American Edit.; 1997 at page 126. Examples include tetrapotassium pyrophosphate, soda ash, sodium hydroxide, sodium metasilicate pentahydrate and potassium hydroxide. Exemplary detergent compositions may include other constituents. For example, the detergent compositions may include 1–20 weight percent of solubilizers and organic solvents such as propylene glycol monobutyl ether. In addition, 0.01–1 weight percent dyes and fragrances may be included. The detergent compositions may further include from 1–99 weight percent of other known low foaming surfactants. Examples include Amphoteric 400 from Tomah Products, Inc. and sodium octyl sulfate.

Other additives such as 0.05–1% enzymes, and 0.10–10% thickeners may be included in the processed surfactant composition. Several exemplary surfactant systems are described more fully below. The amine oxide surfactant concentrate of the invention is compatible with these and other additives and is known to be biodegradable.

The amine oxides of the invention have been studied and have been found to be effective surface-active agents as set forth below. The invention is efficacious for applications as generally described herein.

Given the teachings of the prior art, it was quite unexpected that the amine oxide concentrates of the invention would be highly concentrated pourable liquids at ambient temperature (i.e., about 20° C.) and have low-foam characteristics. Without wishing to be bound by a theoretical explanation of why the inventive concentrates provide the improved characteristics, it is possible that the combination of the hydrophobe and alkyleneoxy units (particularly at levels of above 5 moles of alkyleneoxy units) results in the enhanced liquidity and decreased foaming properties. These inventive combinations of hydrophobes and alkyleneoxy groups yield lower foaming molecules as compared to the prior art dimethylalkyl amine oxides and bis(2-hydroxyethyl)alkyl amine oxides. These novel low-foaming properties give the inventive amine oxide concentrates unique application opportunities not possible with high foaming amine oxides.

EXAMPLES AND DATA

The amine oxide surfactant concentrates of the invention were evaluated with respect to their foaming properties and their activity and liquidity. It was found that the inventive amine oxide surfactant concentrates produced minimal amounts of foam, had high actives and yet were pourable liquids.

A. Foaming Properties

The foaming properties of the exemplary amine oxide concentrates were tested according to the Ross-Miles test protocol ASTM designation D-1173-53. The results of the tests were recorded with respect to initial foam height and to the foam height after two minutes. The amine oxide surfactant concentrate compositions were evaluated in soft water at concentrations ranging from 0.06 to 0.10 weight percent solutions.

EXAMPLES 1–5

Surfactant compositions of deionized water and 0.06% concentrate including a branched ether amine oxide were prepared. The amine oxides used in Examples 1–5 had the following structure:

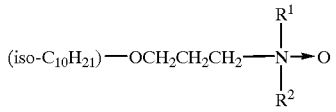

$R^1$ and $R^2$ are as shown in Table 1. Moles of the ethyleneoxy units comprising $R^1$ and $R^2$ in each exemplary molecule are indicated by the x+y column in Table 1. Foam properties of the surfactant compositions at 0.0 minutes and at 2.0 minutes are also noted in Table 1.

TABLE 1

| Example Number | $R^1$ | $R^2$ | x + y | Foam at 0 Minutes | Foam at 2 Minutes |
|---|---|---|---|---|---|
| 1 | $—CH_3$ | $—CH_3$ | — | 10.0 cm | 4.5 cm |
| 2 | $—CH_2CH_2OH$ | $—CH_2CH_2OH$ | — | 4.5 cm | 0.4 cm |
| 3 | $—(CH_2CH_2O)_xH$ | $—(CH_2CH_2O)_yH$ | 5 | 1.5 cm | 0.3 cm |
| 4 | $—(CH_2CH_2O)_xH$ | $—(CH_2CH_2O)_yH$ | 7 | 2.5 cm | 0.7 cm |
| 5 | $—(CH_2CH_2O)_xH$ | $—(CH_2CH_2O)_xH$ | 10 | 2.3 cm | 0.5 cm |

Examples 1 and 2 of Table 1 are prior art molecules provided as a basis of comparison. Examples 3–5 of Table 1 show that including 5 or more moles of ethyleneoxy units results in low-foaming properties. This is particularly apparent when comparing Examples 1 and 2 of Table 1 with Examples 3–5 of Table 1.

EXAMPLE 6–9

Surfactant compositions of deionized water and 0.10% concentrate including a linear fatty-based amine oxide were prepared. The exemplary amine oxide is derived from coconut fatty acids and includes a mixture of molecules in which $R^3$ ranges from $C_6$–$C_{18}$. The amine oxides of the amine oxide constituent had the following structure:

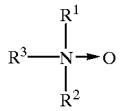

$R^1$ and $R^2$ are as shown in Table 2. The moles of ethyleneoxy units comprising $R^1$ and $R^2$ in each exemplary molecule are shown in the x+y column of Table 2. Table 2 belows shows foam properties of the surfactant compositions at 0.0 minutes and at 2.0 minutes.

TABLE 2

| Example Number | $R^1$ | $R^2$ | x + y | Foam at 0 Minutes | Foam at 2 Minutes |
|---|---|---|---|---|---|
| 6 | $—CH_3$ | $—CH_3$ | — | 14.8 cm | 14.8 cm |
| 7 | $—CH_2CH_2OH$ | $—CH_2CH_2OH$ | — | 14.3 cm | 14.3 cm |
| 8 | $—(CH_2CH_2O)_xH$ | $—(CH_2CH_2O)_yH$ | 5 | 13.1 cm | 13.1 cm |
| 9 | $—(CH_2CH_2O)_xH$ | $—(CH_2CH_2O)_yH$ | 15 | 11.5 cm | 10.8 cm |

Examples 6 and 7 of Table 2 are prior art molecules and are included to provide a basis of comparison. The presence of from 5 to 15 moles of ethyleneoxy units results in lower overall foam formation and foam stability compared to the prior art molecules.

EXAMPLES 10–14

Surfactant compositions consisting of deionized water and 0.06% concentrate including a branched amine oxide having an ether linkage in the hydrophobe were prepared. The amine oxides of the amine oxide constituent had the following structure:

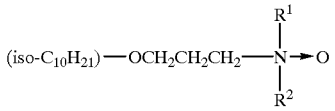

$R^1$ and $R^2$ are as shown in Table 3. The exemplary molecules were prepared using propyleneoxy units in the molar amounts shown in Table 3 below. Foam properties at 0.0 minutes and at 2.0 minutes were recorded as shown in Table 3.

TABLE 3

| Example Number | $R^1$ | $R^2$ | x + y | Foam at 0 Minutes | Foam at 2 Minutes |
|---|---|---|---|---|---|
| 10 | $—CH_3$ | $—CH_3$ | — | 10.0 cm | 4.5 cm |
| 11 | $—CH_2CH(CH_3)OH$ | $—CH_2CH(CH_3)OH$ | — | 4.6 cm | 0.7 cm |
| 12 | $—(CH_2CH(CH_3)O)_xH$ | $—(CH_2CH(CH_3)O)_yH$ | 3.5 | 1.5 cm | 0.1 cm |
| 13 | $—(CH_2CH(CH_3)O)_xH$ | $—(CH_2CH(CH_3)O)_yH$ | 5 | 0.5 cm | 0.1 cm |
| 14 | $—(CH_2CH(CH_3)O)_xH$ | $—(CH_2CH(CH_3)O)_yH$ | 10 | 0.0 cm | 0.0 cm |

Examples 10 and 11 of Table 3 are prior art molecules provided as a basis of comparison. Inclusion of from 3.5–10 moles of propyleneoxy units results in foam formation and foam stability that are greatly lower than the prior art molecules. These compositions exemplify ultra-low-foaming surfactant suitable for use in any of the exemplary low-foaming applications described herein.

EXAMPLES 15–17

Surfactant compositions of deionized water and 0.06% concentrate including a branched amine oxide having an ether linkage in the hydrophobe were prepared. The amine oxides of the amine oxide constituent had the following general structure:

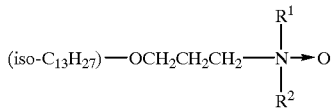

The exemplary molecules include ethyleneoxy and propyleneoxy units in the molar amounts shown in Table 4 below. Table 4 shows the foam properties at 0.0 minutes and at 2.0 minutes.

TABLE 4

| Example Number | $R^1$ | $R^2$ | x + y | Foam at 0 Minutes | Foam at 2 Minutes |
|---|---|---|---|---|---|
| 15 | $—CH_2CH_2OH$ | $—CH_2CH_2OH$ | — | 9.8 cm | 9.0 cm |
| 16 | $—CH_2CH_2O—(CH_2CH(CH_3)O)_xH$ | $—CH_2CH_2O—(CH_2CH(CH_3)O)_yH$ | 3 | 7.5 cm | 5.8 cm |
| 17 | $—CH_2CH_2O—(CH_2CH(CH_3)O)_xH$ | $—CH_2CH_2O—(CH_2CH(CH_3)O)_yH$ | 5 | 5.5 cm | 0.9 cm |

Example 15 of Table 4 is a prior art molecule. Examples 16 and 17 of Table 4 include a mixture of ethyleneoxy and propyleneoxy units. Examples 16 and 17 of Table 4 show that addition of about 5–7 moles of alkoxylated units results in reduced foaming and foam stability. These examples show molecules which are low foaming and ultra-low foaming surfactants. It would be expected that the surfactant molecule would exhibit similar low-foaming properties if other combinations and blends of alkoxylated units were substituted for $R^1$ and $R^2$.

B. Activity Level/Pourability

The data in this section show that the inventive amine oxide surfactant concentrates can be made as pourable liquids at ambient temperature (i.e., about 200° C.) with high actives. The data associated with Tables 5 and 6 below compare the amine oxide concentration of pourable forms of prior art compositions with pourable forms of the invention and show that the inventive compositions are liquid at high concentrations of amine oxide whereas prior art compositions are not. The data associated with Tables 7–12 quantify the viscosity of prior art compositions and compositions of the invention and demonstrate that the invention is pourable at about 506 actives whereas the prior art is a gel or solid at this amine oxide concentration. The high activity and pourability properties shown herein are highly advantageous properties of the invention.

In each case, the final form amine oxide concentrates were prepared with the minimum amounts of water necessary to make the compositions pourable. No organic or other solvents were added. The concentrate compositions were then titrated to determine the activity. The activity level and physical state of the final product were then recorded. The results of these measurements are presented in tables 5–12 which follow.

EXAMPLES 18–22

The activity level of a pourable concentrate composition including an exemplary branched amine oxide with an ether linkage in the hydrophobe was determined. The amine oxide had the following structure:

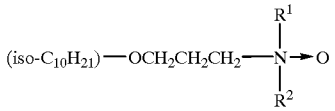

$R^1$ and $R^2$ are as shown in Table 5. The maximum percent actives at which the concentrate was a pourable liquid is shown in the last column of Table 5.

TABLE 5

| Example Number | $R^1$ | $R^2$ | x + y | Maximum Percent Actives |
|---|---|---|---|---|
| 18 | $—CH_3$ | $—CH_3$ | — | 30% |
| 19 | $—CH_2CH_2OH$ | $—CH_2CH_2OH$ | — | 35% |
| 20 | $—(CH_2CH_2O)_xH$ | $—(CH_2CH_2O)_yH$ | 5 | 80% |
| 21 | $—(CH_2CH_2O)_xH$ | $—(CH_2CH_2O)_yH$ | 7 | 85% |
| 22 | $—(CH_2CH_2O)_xH$ | $—(CH_2CH_2O)_yH$ | 10 | 90% |

Examples 18 and 19 of Table 5 are prior art amine oxide compositions provided as a basis for comparison. Activity levels of these examples are known from the literature and specifications of commercial products. Examples 20–22 are concentrates of the invention. These data show that by adding about 5 or more moles of alkyleneoxy units, a dramatic increase in the percent actives can be achieved over the prior art, while retaining liquidity and pourability.

EXAMPLES 23–25

The activity level of an exemplary amine oxide concentrate derived from coconut fatty acid was determined. The amine oxides of the amine oxide constituent all had the following general structure:

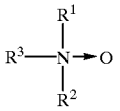

$R^3$ includes many variants from $C_6$–$C_{18}$. This variation is typical of amine oxides derived from coconut fatty acids. $R^1$ and $R^2$ are as shown in Table 6. The maximum percent actives at which the concentrate was pourable at ambient room temperature (i.e., about 20° C.), is shown in column of Table 6.

TABLE 6

| Example Number | $R^1$ | $R^2$ | x + y | Maximum Percent Actives |
|---|---|---|---|---|
| 23 | $—CH_3$ | $—CH_3$ | — | 30% |
| 24 | $—CH_2CH_2OH$ | $—CH_2CH_2OH$ | — | 30% |
| 25 | $—(CH_2CH_2O)_xH$ | $—(CH_2CH_2O)_yH$ | 15 | 90% |

Examples 23 and 24 of Table 6 are prior art amine oxide compositions provided as a basis of comparison. Example 25 is concentrate representative of the invention. In this example, the inventive amine oxide concentrate contains about 15 moles of alkoxylated units and can be prepared as a pourable liquid at above 90% actives. This represents a significant improvement over the prior art amine oxide compositions.

Further experiments were conducted to quantify the viscosity of prior art and inventive compositions at varying amine oxide concentrations. As expected, the prior art composition was an unpourable gel at amine oxide concentrations of about 50% whereas compositions of the invention were clear, pourable liquids at much higher amine oxide concentrations.

In the following examples, concentrate compositions were prepared consisting of amine oxide and water. The compositions were prepared at the maximum amine oxide concentrations indicated in Tables 7–12 and were diluted with water to concentrations also shown in these Tables. No organic solvents were added. In all cases the amine oxide concentration was determined by titration.

The viscosity measurements were made using a Brookfield LVT viscometer with a #2 spindle. Viscosity measurements were made about 5 minutes after preparation of each composition. The temperature of the surfactant solutions was about 20–22° C. The viscosity data are shown in the Tables. Qualitative observations regarding the appearance of each surfactant composition were also presented in the Tables as set forth below.

Viscosity Data for Example 10

The prior art surfactant composition of Example 10 is structurally similar to the amine oxides disclosed in the Swenson patent cited in the background section above. Compositions of this prior art amine oxide and water were prepared with amine oxide concentrations ranging from 75% to 33.4%. The following were observed:

TABLE 7

| % Amine Oxide | Viscosity (cps) | Appearance |
|---|---|---|
| 75.0% | above 100,000 | opaque gel |
| 65.2% | above 100,000 | opaque gel |
| 57.7% | above 100,000 | opaque gel |
| 52.2% | 23,250 | opaque gel |
| 48.2% | 9500 | opaque gel |
| 43.3% | 2040 | clear liquid |
| 38.6% | 175 | clear liquid |
| 33.4% | 95 | clear liquid |

At about 48.2% actives the composition of Example 10 was observed to be gelatinous and not pourable. The composition did not become a pourable liquid until the amine oxide concentration was decreased to about 43.3%. These data show that, in the absence of organic solvent, prior art compositions would not be expected to be pourable liquids with activity levels above 50%.

In addition, the prior art composition of Example 10 was prepared at a 50% amine oxide concentration to observe the viscosity 24 hours after preparation. It is envisioned that commercial forms of the invention will be stored prior to sale and that the viscosity 24 hours following preparation will approximate the viscosity of the product at the time of sale.

After 24 hours it was observed that the bottle in which the prior art composition was stored could be inverted and that the composition did not flow at all. The composition appeared gelatinous as would be expected of prior art amine oxide compositions at about 50% actives.

Viscosity Data for Example 12

Example 12 from Table 3 above represents one of the inventive compositions. Example 12 differs from the prior art composition of Example 10 in that it includes about 3.5 moles of propyleneoxy units. The viscosity of Example 12 is markedly different from that of the composition of Example 10 as noted by the following data:

TABLE 8

| % Amine Oxide | Viscosity (cps) | Appearance |
|---|---|---|
| 80.0% | 417 | clear liquid |
| 74.1% | 242 | clear liquid |
| 68.3% | 160 | clear liquid |
| 62.2% | 118 | clear liquid |
| 57.1% | 93 | clear liquid |
| 50.4% | 71 | clear liquid |
| 40.0% | 42 | clear liquid |

The composition of Example 12 is a clear liquid at all amine oxide concentrations shown in Table 8. The low viscosity is consistent with the observation that the composition is a liquid and not a gel or solid.

A 50% actives specimen of the amine oxide composition of Example 12 was prepared and the viscosity noted after 24 hours. Quite unlike the prior art composition of Example 10, the composition of Example 12 remained a clear, pourable liquid after 24 hours.

Viscosity Data for Examples 20 and 21

Examples 20 and 21 set forth in Table 5 above represent other examples of the inventive compositions. Examples 20 and 21 include about 5 and 7 moles of ethyleneoxy units respectively. The viscosity of these exemplary compositions is as set forth in Tables 9 and 10:

TABLE 9

(Example 20)

| % Amine Oxide | Viscosity (cps) | Appearance |
|---|---|---|
| 80.0% | 589 | clear liquid |
| 66.0% | 286 | clear liquid |
| 61.1% | 229 | clear liquid |
| 56.9% | 178 | clear liquid |
| 52.3% | 120 | clear liquid |
| 48.0% | 78 | clear liquid |
| 43.5% | 47 | clear liquid |
| 39.9% | 32 | clear liquid |

TABLE 10

(Example 21)

| % Amine Oxide | Viscosity (cps) | Appearance |
|---|---|---|
| 90.0% | 758 | clear liquid |
| 86.4% | 480 | clear liquid |
| 83.8% | 387 | clear liquid |
| 81.4% | 329 | clear liquid |
| 79.2% | 284 | clear liquid |
| 77.6% | 265 | clear liquid |
| 74.6% | 232 | clear liquid |
| 69.1% | 203 | clear liquid |
| 64.2% | 169 | clear liquid |
| 59.9% | 141 | clear liquid |
| 54.6% | 106 | clear liquid |
| 50.1% | 75 | clear liquid |
| 46.1% | 53 | clear liquid |
| 42.9% | 39 | clear liquid |
| 40.9% | 30 | clear liquid |
| 37.5% | 24 | clear liquid |

As with the other inventive compositions, Examples 20 and 21 are clear liquids at all amine oxide concentrations. The viscosities are once again low consistent with the observation that the inventive compositions have improved liquid-handling properties and are not gels or solids typical of the prior art.

Viscosity observations after 24 hours were also made based on samples of Examples 20 and 21 with about 50% amine oxide concentrations. As with the other inventive compositions, the 50% actives forms of Examples 20 and 21 remained clear, pourable liquids after 24 hours.

Viscosity Data for Variant of Examples 20 and 21

An exemplary composition was prepared pursuant to the invention having the same structure as shown in Examples 20 and 21 of Table 5 but in which x+y=15 moles of ethyleneoxy units. The viscosity data for this variant are presented in Table 11 below:

TABLE 11

| % Amine Oxide | Viscosity (cps) | Appearance |
|---|---|---|
| 88.0% | 423 | clear liquid |
| 83.3% | 250 | clear liquid |
| 80.4% | 212 | clear liquid |
| 77.0% | 176 | clear liquid |
| 72.8% | 155 | clear liquid |
| 68.9% | 140 | clear liquid |
| 64.0% | 131 | clear liquid |
| 60.7% | 116 | clear liquid |
| 55.2% | 94 | clear liquid |

TABLE 11-continued

| % Amine Oxide | Viscosity (cps) | Appearance |
|---|---|---|
| 51.3% | 77 | clear liquid |
| 46.9% | 63 | clear liquid |
| 44.2% | 45 | clear liquid |
| 41.8% | 37 | clear liquid |
| 39.9% | 32 | clear liquid |

The data show that the inventive composition is a clear liquid at amine oxide concentrations of from about 88 to 39%. This composition is easily pourable at all activity levels above 50%—a significant and unexpected improvement in pourability over prior art compositions.

Moreover, observations of a 50% actives specimen of this embodiment 24 hours after preparation showed that the composition remained a clear, pourable liquid.

Viscosity Data for Variant of Examples 12—14

Another example of the invention was prepared according to Examples 12—14 in Table 3 above except that $R^1$ is $—(CH_2CH_2O)_X(CH_2CH(CH_3)O)_ZH$, $R^2$ is $—(CH_2CH_2O)_Y(CH_2CH(CH_3)O)_WH$, X+Y=5 and Z+W=5. The viscosity of this inventive composition is presented in Table 12:

TABLE 12

| % Amine Oxide | Viscosity (cps) | Appearance |
|---|---|---|
| 90.0% | 468 | clear liquid |
| 85.7% | 282 | clear liquid |
| 81.7% | 198 | clear liquid |
| 78.3% | 159 | clear liquid |
| 74.9% | 134 | clear liquid |
| 69.2% | 99 | clear liquid |
| 58.6% | 74 | clear liquid |
| 54.7% | 62 | clear liquid |
| 50.0% | 4S | clear liquid |
| 44.7% | 34 | clear liquid |
| 40.3% | 27 | clear liquid |
| 37.5% | 25 | clear liquid |

Once again the data show that the inventive compositions have both excellent pourability at high and low amine oxide concentrations. Observation of a 50% actives form of this exemplary composition demonstrated that the composition remained a clear liquid 24 hours following preparation.

C. Surface Tension Data

EXAMPLE 26

The surface tension of the following inventive amine oxide was determined:

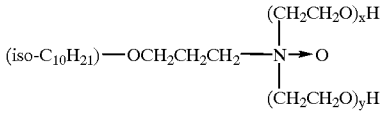

The moles of alkoxylated units included in this example is 5 (i.e., x+y=5). The surface tension of the exemplary molecule was measured with a du Nouy interfacial tensiometer at room temperature, at various concentrations in deionized water. The concentrations are set forth in Table 7.

TABLE 13

(Example 26)

| Amine Oxide Concentration | Surface Tension (dynes) |
|---|---|
| 0.003% | 58.5 |
| 0.01% | 51.5 |
| 0.03% | 41.0 |
| 0.1% | 32.1 |
| 0.3% | 29.7 |
| 1.0% | 32.1 |
| 10.0% | 32.5 |

The lowest surface tension achieved was 29.7 dynes at an amine oxide concentration of approximately 0.3%. The critical micelle concentration is exhibited at about 0.1% amine oxide concentration. These data show that the composition of this invention is surface-active and should exhibit efficacy in the intended applications.

D. Exemplary Formulations

As important benefit of the invention is that the amine oxide concentrate can be diluted and blended with other compounds to provide formulations of interest to end users. Typically, preparation of the final form of the composition would be prepared by a formulator. It is envisioned (although by no means required) that the formulator would purchase the amine oxide in its concentrated form. The formulator would then prepare the final form of the composition to meet the specific needs of the end user.

Examples 27–29 show three exemplary formulations including amine oxides of the invention. All of the compositions were prepared using the inventive concentrate as a precursor. It should be noted that the compositions of Examples 27–29 are typically diluted from 100:1 to 1000:1 with water before final use. All of the formulations included an amine oxide having the general structure:

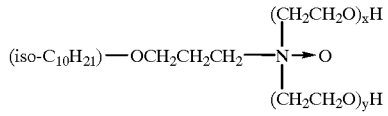

The moles of alkoxylated units in this example is 5 (i.e., x+y=5). The amine oxide concentrate used in Examples 27–29 was prepared as an 80% actives solution in water. It is apparent that many additional formulations may be prepared using the amine oxide surfactant concentrate which are within the scope of the present invention.

The compositions of Examples 27–29 were mixed with water to form 0.1–1 weight percent surfactant solutions typical of final-form formulations. These formulations were subjected to a high-shear blending in order to determine their foam-producing characteristics. The formulations were visually inspected following the blending. All of the exemplary formulations were found to be low foaming.

EXAMPLE 27

Example 27 is an exemplary carpet cleaning formulation. The formulation includes the following constituents:

| | Weight Percent |
|---|---|
| Water | 92.8 |
| Sodium Octyl Sulfate | 1.0 |
| Ethylene Diamine Tetraacetic | 0.2 |

-continued

| | Weight Percent |
|---|---|
| Acid, Tetrasodium Salt | |
| Propylene Glycol Monobutyl Ether | 3.0 |
| Amine Oxide (80% solution in water) | 3.0 |

Example 27 shows the amine oxide concentrate when used in conjunction with a second low-foaming anionic surfactant. The other components are a sequestering agent and a solvent. This example shows the amine oxide in a final formulation with large amounts of water and other cleaning ingredients.

EXAMPLE 28

Example 28 is an exemplary machine floor cleaner formulation. The formulation includes the following constituents:

| | Weight Percent |
|---|---|
| Water | 83.0 |
| Potassium Hydroxide, (45% solution) | 2.5 |
| Tetrapotassium Pyrophosphate | 8.0 |
| Amine Oxide (80% solution in water) | 3.0 |
| Tomah Amphoteric 400 | 3.5 |

Example 28 includes the amine oxide concentrate in the presence of other commercial builders and a low-foaming amphoteric coupling agent. (Tomah Amphoteric 400). The example shows the use of the amine oxide in an alkaline system.

EXAMPLE 29

Example 29 is an exemplary low temperature powdered detergent formulation. The formulation includes the following constituents:

| | Weight Percent |
|---|---|
| Sodium Metasilicate Pentahydrate | 35.0 |
| Soda Ash | 25.0 |
| Tetrapotassium Pyrophosphate | 20.0 |
| Sodium Hydroxide | 15.0 |
| Amine Oxide (80% solution in water) | 5.0 |

Example 29 shows the amine oxide concentrate in combination with four builders. The high amine oxide concentration characteristic of the invention allows the amine oxide to be easily incorporated into solid cleaning products.

While the principles of this invention have been described in connection with specific embodiments, it should be understood clearly that these descriptions are made only by way of example and are not intended to limit the scope of the invention.

What is claimed:

1. A low-foaming amine oxide surfactant concentrate having from about amine oxides and which is pourable at room temperature comprising:

50–99% of an amine oxide constituent, such constituent including at least one amine oxide having the general structural formula:

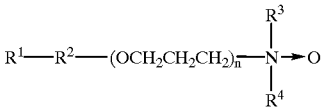

wherein $R^1$ is selected from an alkyl group having between 6 and 22 carbon atoms, and a substituted aryl group having between 7 and 22 carbon atoms;

$R^2$ is from 0 to 7 moles of alkoxylated units;

n is 0 or 1; and $R^3$ and $R^4$ are each at least one alkoxylated unit and the total number of alkoxylated units present in $R^3$ and $R^4$ is about 3.5 to 30; and less than 50% water, wherein said concentrate is essentially free of organic solvents.

2. The concentrate composition of claim 1 wherein the composition includes at least 80% amine oxide constituent and less than about 20% water.

3. The concentrate composition of claim 2 wherein the composition includes at least 90% amine oxide constituent and less than about 10% water.

4. The concentrate composition of claim 1 wherein $R^2$ is an alkoxylated unit selected from ethyleneoxy, propyleneoxy, butyleneoxy and mixtures thereof.

5. The concentrate composition of claim 1 wherein $R^3$ and $R^4$ are each alkoxylated units selected from ethyleneoxy, propyleneoxy, butyleneoxy and mixtures thereof.

6. The concentrate composition of claim 5 wherein $R^3$ and $R^4$ are each ethyleneoxy units.

7. The concentrate composition of claim 1 wherein the total number of alkoxylated units present in $R^3$ and $R^4$ is about 5 to 20.

8. The concentrate composition of claim 7 wherein the total number of alkoxylated units preset in $R^3$ and $R^4$ is about 5 to 15.

9. The concentrate composition of claim 1 wherein the viscosity is less than about 5000 centipoise.

10. The concentrate composition of claim 1 wherein the amine oxide has the has the general structural formula:

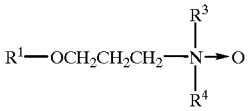

wherein $R^1$ is selected from a substituted aryl group having between 7 and 22 carbon atoms and an alkyl group having between 6 and 22 carbon atoms; and $R^3$ and $R^4$ are each at least one alkoxylated unit and the total number of alkoxylated units present in $R^3$ and $R^4$ is about 3.5 to 30.

11. The concentrate composition of claim 10 wherein $R^3$ and $R^4$ are each alkoxylated units, such units being selected from ethyleneoxy, propyleneoxy, and mixtures thereof.

12. The concentrate composition of claim 11 wherein $R^3$ and $R^4$ are each ethyleneoxy units.

13. The concentrate composition of claim 11 wherein the total number of alkoxylated units present in $R^3$ and $R^4$ is about 4 to 10.

14. The concentrate composition of claim 9 wherein the viscosity is less than about 5000 centipoise.

15. The concentrate composition of claim 1 wherein the amine oxide has the has the general structural formula:

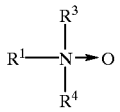

wherein $R^1$ is selected from an alkyl group having between 6 and 22 carbon atoms and a substituted aryl group having between 7 and 22 carbon atoms;

$R^3$ and $R^4$ are each from 1 to 30 moles of alkoxylated units and the total number of alkoxylated units present in $R^3$ and $R^4$ is about 3.5 to 30.

16. The composition of claim 15 wherein $R^3$ and $R^4$ are each alkoxylated units selected from ethyleneoxy, propyleneoxy, butyleneoxy and mixtures thereof.

17. The composition of claim 16 wherein $R^3$ and $R^4$ each are ethyleneoxy units.

18. The composition of claim 15 wherein the total number of alkoxylated units present in $R^3$ and $R^4$ is about 5 to 15.

19. The concentrate composition of claim 15 wherein the viscosity is less than about 5000 centipoie.

20. A method of making a low-foaming amine oxide surfactant concentrate, said concentrate being essentially free of organic solvents, said concentrate having from about 50–99% actives and being pourable at room temperature comprising the steps of:

providing a tertiary amine constituent having the general structural formula:

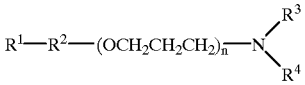

wherein $R^1$ is selected from an alkyl group having between 6 and 22 carbon atoms, and a substituted aryl group having between 7 and 22 carbon atoms;

$R^2$ is from 0 to 7 moles of alkoxylated units;

n is 0 or 1; and $R^3$ and $R^4$ are each at least one alkoxylated unit and the total number of alkoxylated units present in $R^3$ and $R^4$ is about 3.5 to 30;

placing the amine constituent in a reaction vessel and heating the amine to a reaction temperature of about 50–70° C.;

adding to the heated amine constituent in the reaction vessel, 100–105 molar percent of hydrogen peroxide present in a solution of water in about equal amounts over a period of about 2–8 hours;

reacting the amine and hydrogen peroxide for about 8–48 hours at about 70–80° C.;

adding at any point in the process less than 50% water as necessary to enhance pourability;

whereupon a high actives, pourable amine oxide surfactant concentrate is formed.

21. The method of claim 20 further including the step of adding a chelating agent to the amine constituent in the reaction vessel to stabilize the amine oxide.

22. The method of claim 20 wherein the composition has a viscosity of about less than about 5000 centipoise.

* * * * *

UNITED STATES PATENT AND TRADEMARK OFFICE

CERTIFICATE OF CORRECTION

PATENT NO. : 5,972,875

DATED : October 26, 1999

INVENTOR(S) : Crutcher et al.

It is certified that error appears in the above-identified patent and that said Letters Patent is hereby corrected as shown below:

At column 5, line 67, change "Surpris- ingly" to --Surprisingly--.
At column 8, line 59, change "bclows" to --below--.
At column 11, line 12, change "200°" to --20°--.
At column 11, line 21, change "506" to --50%--.
At column 15, line 6, change "46.9%" to --48.9%--.
At column 15, line 38, change "4S" to --45--.
At column 18, line 17, insert a new paragraph before "less" so that the "l" in less is aligned beneath the "$R^3$" at line 15.
At column 18, line 17, after "water" delete ", wherein said concentrate is essentially free of organic solvents".
At column 18, line 37, change "preset" to --present--.
At column 18, line 42, after "the" delete "has the".
At column 19, line 2, after "the" delete "has the".
At column 19, line 27, change "centipoie" to --centipoise--.
At column 19, line 29, after "concentrate," delete "said concentrate being essentially free of organic solvents,".

Signed and Sealed this

Third Day of October, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,972,875

DATED : October 26,1999

INVENTOR(S) : Crutcher et al.

It is certified that error appears in the above-identified patent and that said Letters Patent is hereby corrected as shown below:

In the Claims:

In column 17, line 63, after "about" and before "amine" insert --50%-90%--.

In column 17, line 65, delete "50%-90% of--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*